US010351939B2

(12) United States Patent
Omori et al.

(10) Patent No.: US 10,351,939 B2
(45) Date of Patent: Jul. 16, 2019

(54) CU—AL—MN-BASED ALLOY EXHIBITING STABLE SUPERELASTICITY AND METHOD OF PRODUCING THE SAME

(71) Applicants: TOHOKU UNIVERSITY, Sendai-shi, Miyagi (JP); FURUKAWA TECHNO MATERIAL CO., LTD., Hiratsuka-shi, Kanagawa (JP); FURUKAWA ELECTRIC CO., LTD., Tokyo (JP)

(72) Inventors: Toshihiro Omori, Sendai (JP); Shingo Kawata, Sendai (JP); Ryosuke Kainuma, Sendai (JP); Kiyohito Ishida, Sendai (JP); Toyonobu Tanaka, Hiratsuka (JP); Kenji Nakamizo, Hiratsuka (JP); Sumio Kise, Hiratsuka (JP); Koji Ishikawa, Hiratsuka (JP); Misato Nakano, Tokyo (JP); Satoshi Teshigawara, Tokyo (JP)

(73) Assignees: TOHOKU UNIVERSITY, Sendai-Shi, Miyagi (JP); FURUKAWA TECHNO MATERIAL CO., LTD., Hiratsuka-Shi, Kanagawa (JP); FURUKAWA ELECTRIC CO., LTD., Tokyo (JP)

( * ) Notice: Subject to any disclaimer, the term of this patent is extended or adjusted under 35 U.S.C. 154(b) by 614 days.

(21) Appl. No.: 14/658,891

(22) Filed: Mar. 16, 2015

(65) Prior Publication Data

US 2015/0225826 A1 Aug. 13, 2015

Related U.S. Application Data

(63) Continuation of application No. PCT/JP2013/074416, filed on Sep. 10, 2013.

(30) Foreign Application Priority Data

Sep. 16, 2012 (JP) ..... 2012-221685

(51) Int. Cl.
*C22F 1/08* (2006.01)
*C22C 9/01* (2006.01)
(Continued)

(52) U.S. Cl.
CPC ..... *C22F 1/08* (2013.01); *C22C 9/01* (2013.01); *C22C 9/05* (2013.01); *C22F 1/002* (2013.01); *C22F 1/006* (2013.01)

(58) Field of Classification Search
CPC ..... C22C 9/01; C22C 9/05; C22F 1/08
(Continued)

(56) References Cited

U.S. PATENT DOCUMENTS

| | | | | |
|---|---|---|---|---|
| 6,406,566 | B1 | 6/2002 | Ishida et al. | |
| 2002/0003014 | A1 | 1/2002 | Homma | |
| 2016/0060740 | A1* | 3/2016 | Omori | C22C 9/01 148/563 |

FOREIGN PATENT DOCUMENTS

| | | | |
|---|---|---|---|
| CN | 101100713 | A | 1/2008 |
| JP | 7-062472 | A | 3/1995 |

(Continued)

OTHER PUBLICATIONS

Chinese Office Action dated Apr. 27, 2016, issued in corresponding Chinese Patent Application No. 201380047764.4.

(Continued)

*Primary Examiner* — Jie Yang
(74) *Attorney, Agent, or Firm* — Birch, Stewart, Kolasch & Birch, LLP

(57) ABSTRACT

A Cu—Al—Mn-based alloy having superelastic characteristics and having a recrystallized texture substantially formed of a β single phase, in which 70% or more of crystal grains is within a range of 0° to 50° in a deviation angle from
(Continued)

<001> orientation of a crystalline orientation measured in a working direction by electron back-scatter diffraction patterning.

4 Claims, 4 Drawing Sheets

(51) Int. Cl.
*C22C 9/05* (2006.01)
*C22F 1/00* (2006.01)
(58) Field of Classification Search
USPC ..... 148/554
See application file for complete search history.

(56) References Cited

FOREIGN PATENT DOCUMENTS

| | | | |
|---|---|---|---|
| JP | 2000-169920 | A | 6/2000 |
| JP | 2001-020026 | A | 1/2001 |
| JP | 2005-298952 | A | 10/2005 |

OTHER PUBLICATIONS

Extended European Search Report, dated Jun. 13, 2016, for corresponding European Application No. 13837557.1.
International Search Report issued in PCT/JP2013/074416, dated Nov. 5, 2013.
Shingo Kawada, "3-Genkei Cu—Al—Mn Chodansei Gokin ni Okeru Kako Netsushori to Shugo Soshiki", Abstracts of the Japan Institute of Metals, vol. 151, Sep. 3, 2012, p. 604.

* cited by examiner

Crystalline orientation in RD

Crystalline orientation dependency of the amount of transformation strain of the Cu-Al-Mn-based alloy

CU—AL—MN-BASED ALLOY EXHIBITING STABLE SUPERELASTICITY AND METHOD OF PRODUCING THE SAME

CROSS-REFERENCE TO RELATED APPLICATIONS

This application is a Continuation of PCT International Application No. PCT/JP2013/074416 filed on Sep. 10, 2013, which claims priority under 35 U.S.C. § 119 (a) to Japanese Patent Application No. 2012-221685 filed in Japan on Sep. 16, 2012. Each of the above applications is hereby expressly incorporated by reference, in its entirety, into the present application.

TECHNICAL FIELD

The present invention relates to a Cu—Al—Mn-based alloy excellent in superelastic characteristics and to a method of producing the same.

BACKGROUND ART

Shape memory alloys/superelastic alloys, such as copper alloys, exhibit a remarkable shape memory effect and superelastic characteristics concomitantly to reverse transformation of the thermoelastic martensite transformation, and have excellent functions near the living environment temperature. Accordingly, these alloys have been put to practical use in various fields. Representative alloys of the shape memory alloys/superelastic alloys include TiNi alloys and Cu-based alloys. Copper-based shape memory alloys/superelastic alloys (hereinafter, copper-based alloys) have characteristics inferior to those of TiNi alloys in terms of repetition characteristics, corrosion resistance, and the like. On the other hand, since the cost is inexpensive, there has been a movement to extend the application range of copper-based alloys. However, although copper-based alloys are advantageous in terms of cost, those alloys are poor in cold workability and inferior in superelastic characteristics. For this reason, despite that a variety of studies are being conducted, it is the current situation that practicalization of copper-based alloys has not been necessarily sufficiently progressed.

Heretofore, various investigations have been conducted on copper-based alloys. For example, Cu—Al—Mn-based shape memory alloys having a recrystallized texture in which particular crystalline orientations, such as <101> and <100>, of a β single phase are aligned in the direction of cold work, such as rolling or wire-drawing, for example, having a β single phase structure with excellent cold workability, have been reported in Patent Literatures 1 to 4 described below.

CITATION LIST

Patent Literatures

Patent Literature 1: JP-A-7-62472 ("JP-A" means unexamined published Japanese patent application)
Patent Literature 2: JP-A-2000-169920
Patent Literature 3: JP-A-2001-20026
Patent Literature 4: JP-A-2005-298952

SUMMARY OF INVENTION

Technical Problem

A Cu—Al—Mn-based alloy produced by the method of Patent Literature 1 does not have satisfactory characteristics, particularly superelastic characteristics, and the maximum given strain that exhibits shape recovery of 90% or more is about 2 to 3%. Regarding the reason for this, it is speculated that because a strong restraining force is generated among crystal grains at the time of deformation due to reasons, such as the crystalline orientation being random, irreversible defects, such as transition, are introduced.

Further, the copper-based alloy of Patent Literature 2 is a copper-based alloy which has shape memory characteristics and superelastic characteristics and which is substantially formed of a β single phase, and the crystal structure is a recrystallized texture in which in the crystalline orientation of the β single phase, particular crystalline orientations, such as <101> and <100>, of the β single phase are aligned in the direction of cold working, such as rolling or wire-drawing. In the above-described copper-based alloy, the cold working is performed at a total working ratio after final annealing, at which the frequency of existence of a particular crystalline orientation of the β single phase in the working direction measured by Electron Back-Scatter Diffraction Patterning (hereinafter, may be abbreviated to "EBSP") (alternatively, also referred to as Electron BackScatter Diffraction (hereinafter, also abbreviated as EBSD)) is 2.0 or higher. Even if the alloy is such a material as described above, since the amount of transformation strain is highly dependent on orientation in Cu—Al—Mn-based alloys, it was insufficient to stably obtain satisfactory superelastic characteristics precisely and uniformly.

In the copper-based alloy described in Patent Literature 3, the shape memory characteristics and superelastic characteristics to be manifested by the alloy are less stable, and, from the viewpoint that these characteristics are not stable, the copper-based alloy is at a level having a room for further improvement. Further, it is presumed that texture controlling is indispensable in order to stabilize the shape memory characteristics and superelastic characteristics. However, in the method described in Patent Literature 3, the degree of integration of the texture in the Cu—Al—Mn-based alloy is low, and the shape memory characteristics and superelastic characteristics are not yet sufficiently stabilized.

Further, in the alloy described in Patent Literature 4, Ni inclusion is essential, and a Ni content of up to 10% by mass is allowed. As the alloy contains Ni, integration of crystalline orientations is made easier, but quench-hardening property is decreased. Herein, quench-hardening property (or quench-hardening sensitivity) refers to the relationship between the cooling speed at the time of quench-hardening and the stability in the quench-hardening process of the texture immediately before quench-hardening. Specifically, if the cooling speed after quench-hardening is slow, an α phase is precipitated, causing deteriorated superelastic characteristics, and this is said that quench-hardening property is sensitive. It was found that in a Ni-containing copper alloy, since an α phase begins to precipitate at a higher temperature, quench-hardening property is deteriorated even only if the cooling time is slightly elongated due to an increase in the wire diameter or the like, and satisfactory superelastic characteristics are not obtained.

As such, in regard to those shape memory copper alloys that have been hitherto obtained, it has been believed that theoretically monocrystalline alloys are desirable. However, the investigation on the influence of the integration of crystalline orientations on superelastic characteristics in a polycrystalline material has been insufficiently achieved, and the conventional shape memory copper alloys lack stability and reproducibility of the superelastic characteristics.

The present invention is implemented for providing a Cu—Al—Mn-based alloy which stably exhibits satisfactory superelastic characteristics by controlling the crystalline texture of the alloy, and for providing a method of producing the same.

Solution to Problem

The inventors of the present invention conducted a thorough investigation in order to solve the problems of the related art as described above. As a result, we found that when a texture in which the crystalline orientations of a Cu—Al—Mn-based alloy are controlled and integrated to a particular crystalline orientation is adopted, a Cu—Al—Mn-based alloy is obtained, which exhibits satisfactory superelastic characteristics more stably. The inventors also found that such a texture controlling can be achieved by subjecting the alloy to predetermined intermediate annealing and cold working, and further performing a heat treatment. The present invention was completed based on these findings.

That is, the present invention provides the following means:

(1) A Cu—Al—Mn-based alloy having superelastic characteristics and having a recrystallized texture substantially formed of a β single phase, wherein 70% or more of crystal grains is within a range of 0° to 50° in a deviation angle from <001> orientation of a crystalline orientation measured in a working direction by electron back-scatter diffraction patterning.

(2) The Cu—Al—Mn-based alloy described in item (1), wherein 50% or more of the crystal grains is within a range of 0° to 20° in a deviation angle from <101> orientation of the crystalline orientation measured in the working direction.

(3) The Cu—Al—Mn-based alloy described in the item (1) or (2), wherein the Cu—Al—Mn alloy has a composition containing 3 to 10% by mass of Al, 5 to 20% by mass of Mn, and 1% by mass or less of Ni, with the balance being Cu and unavoidable impurities.

(4) The Cu—Al—Mn-based alloy described in any one of the items (1) to (3), wherein the Cu—Al—Mn alloy has a composition containing 3 to 10% by mass of Al; 5 to 20% by mass of Mn; 0.001 to 10% by mass in total of at least one element selected from the group consisting of Co, Fe, Ti, V, Cr, Si, Nb, Mo, W, Sn, Mg, P, Be, Sb, Cd, As, Zr, Zn, B, C, Ag and misch metal; and 1% by mass or less of Ni, with the balance being Cu and unavoidable impurities.

(5) A method of producing a Cu—Al—Mn-based alloy having a composition containing 3 to 10% by mass of Al, 5 to 20% by mass of Mn, and 1% by mass or less of Ni, with the balance being Cu and unavoidable impurities, through [Step 1] to [Step 5]:

melting and casting [Step 1] an alloy material which gives the composition; subjecting to hot working [Step 2]; carrying out at least one each in this order: intermediate annealing at 400° C. to 600° C. for 1 minute to 120 minutes [Step 3] and cold working at a working ratio of 30% or higher [Step 4]; and then carrying out heat treatment [Step 5], wherein the heat treatment [Step 5] contains steps of a heat treatment of: heating the alloy from room temperature to a temperature range for obtaining a β single phase at a rate of temperature raise of 0.2° C./min to 20° C./min, and maintaining the alloy at the heating temperature; and then quenching.

(6) A method of producing a Cu—Al—Mn-based alloy having a composition containing 3 to 10% by mass of Al; 5 to 20% by mass of Mn; 0.001 to 10% by mass in total of at least one element selected from the group consisting of Co, Fe, Ti, V, Cr, Si, Nb, Mo, W, Sn, Mg, P, Be, Sb, Cd, As, Zr, Zn, B, C, Ag and misch metal; and 1% by mass or less of Ni, with the balance being Cu and unavoidable impurities, through [Step 1] to [Step 5]:

melting and casting [Step 1] an alloy material which gives the composition; subjecting to hot working [Step 2]; carrying out at least one each in this order: intermediate annealing at 400° C. to 600° C. for 1 minute to 120 minutes [Step 3] and cold working at a working ratio of 30% or higher [Step 4]; and then carrying out heat treatment [Step 5], wherein the heat treatment [Step 5] contains steps of a heat treatment of: heating the alloy from room temperature to a temperature range for obtaining a β single phase at a rate of temperature raise of 0.2° C./min to 20° C./min, and maintaining the alloy at the heating temperature; and then quenching.

(7) A wire formable from the Cu—Al—Mn-based alloy described in the item (3) or (4).

(8) A sheet formable from the Cu—Al—Mn-based alloy described in the item (3) or (4).

(9) A Cu—Al—Mn-based alloy producible by the method of producing a Cu—Al—Mn-based alloy having a composition containing 3 to 10% by mass of Al, 5 to 20% by mass of Mn, and 1% by mass or less of Ni, with the balance being Cu and unavoidable impurities, through [Step 1] to [Step 5]:

melting and casting [Step 1] an alloy material which gives the composition; subjecting to hot working [Step 2]; carrying out at least one each in this order: intermediate annealing at 400° C. to 600° C. for 1 minute to 120 minutes [Step 3] and cold working at a working ratio of 30% or higher [Step 4]; and then carrying out heat treatment [Step 5], wherein the heat treatment [Step 5] contains steps of a heat treatment of: heating the alloy from room temperature to a temperature range for obtaining a β single phase at a rate of temperature raise of 0.2° C./min to 20° C./min, and maintaining the alloy at the heating temperature; and then quenching.

(10) A Cu—Al—Mn-based alloy producible by the method of producing a Cu—Mn—Al-based alloy having a composition containing 3 to 10% by mass of Al; 5 to 20% by mass of Mn; 0.001 to 10% by mass in total of at least one element selected from the group consisting of Co, Fe, Ti, V, Cr, Si, Nb, Mo, W, Sn, Mg, P, Be, Sb, Cd, As, Zr, Zn, B, C, Ag and misch metal; and 1% by mass or less of Ni, with the balance being Cu and unavoidable impurities, through [Step 1] to [Step 5]:

melting and casting [Step 1] an alloy material which gives the composition; subjecting to hot working [Step 2]; carrying out at least one each in this order: intermediate annealing at 400° C. to 600° C. for 1 minute to 120 minutes [Step 3] and cold working at a working ratio of 30% or higher [Step 4]; and then carrying out heat treatment [Step 5], wherein the heat treatment [Step 5] contains steps of a heat treatment of: heating the alloy from room temperature to a temperature range for obtaining a β single phase at a rate of temperature raise of 0.2° C./min to 20° C./min, and maintaining the alloy at the heating temperature; and then quenching.

The Cu—Al—Mn-based alloy of the present invention is preferably such that, as the superelastic characteristics, the residual strain after 6% strain loading is 1.0% or less, and the elongation at breakage is 6% or more.

Herein, the expression 'superelastic characteristics are excellent', the strain remaining when a predetermined loading strain or loading stress is applied and then the load is eliminated, is referred to as residual strain, and it is meant that this residual strain is small. It is more desirable as this residual strain is smaller. In the present invention, it is meant that the residual strain after 6% deformation is generally 1.0% or less, preferably 0.5% or less, and more preferably 0.2% or less. Also, the expression 'having a recrystallized texture substantially formed from a β single phase' means that the proportion occupied by a β phase in the recrystallization structure is generally 90% or more, and preferably 95% or more.

Advantageous Effects of Invention

The Cu—Al—Mn-based superelastic alloy of the present invention can be used in various applications where superelastic characteristic are required, and applications are expected, for example, in antennas of mobile phones, spectacle frames, as well as orthodontic wires, guide wires, stents, and correcting tools for ingrown nails, and orthoses for hallux valgus, as medical products. Further, the Cu—Al—Mn-based superelastic alloy of the present invention is suitable as a vibration damping material, due to its excellent superelastic characteristics.

Other and further features and advantages of the invention will appear more fully from the following description, appropriately referring to the accompanying drawings.

BRIEF DESCRIPTION OF DRAWINGS

FIG. 1(*b*) is a crystalline orientation distribution diagram using an inverse pole figure that schematically presents that the deviation angle from <101> orientation of the crystalline orientation defined in the present invention is in the range of 0° to 20°, and preferably 0° to 10°. Further, FIG. 1(*c*) is a crystalline orientation distribution diagram using an inverse pole figure that schematically presents a region in which the deviation angle from <001> orientation is in the range of 0° to 50° (preferably 20° to 50°), and the deviation angle from <101> orientation is in the range of 0° to 20° (preferably 0° to 10°), and both of these conditions are satisfied.

in FIG. 2(*a*), 550° C. in FIG. 2(*b*), or 600° C. in FIG. 2(*c*), together with the color maps in various RD's by EBSD (lower row, shown in black-and-white in the diagrams). FIG. 2(*d*) is an explanatory diagram showing the crystalline orientation dependency of the amount of transformation strain of the Cu—Al—Mn-based alloy, by way of contour lies of the amount of strain in the inverse pole figure.

FIG. 4(*b*) is a chart presenting an example of the working process of the production method for comparison of performing the heating [Step 5-1] of the heat treatment with a rapid temperature raise at 90° C./min.

FIG. 5(*b*) is a stress-strain curve (S-S curve) showing the residual strain as the superelastic characteristics obtained by the process of FIG. 4(*b*).

MODE FOR CARRYING OUT THE INVENTION

Figure 1A:
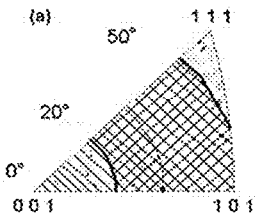
FIG. 1(*a*) is a crystalline orientation distribution diagram using an inverse pole figure that schematically presents that the deviation angle from <001> orientation of the crystalline orientation defined in the present invention is in the range of 0° to 50° (the hatched region and the checkered region), and preferably 20° to 50° (only the checkered region)
Figure 1B:
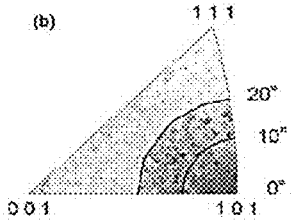
Figure 1C:
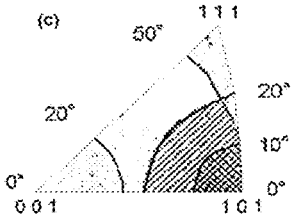
Figure 1C:
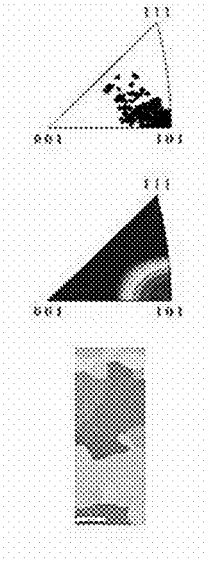
Figure 1C:
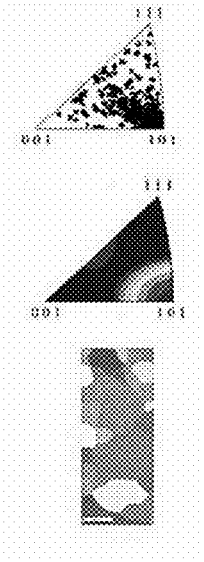
Figure 1C:
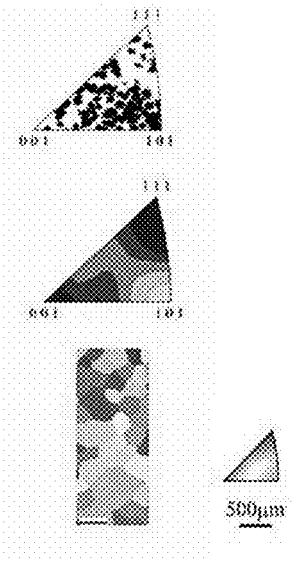

The Cu—Al—Mn-based alloy of the present invention stably exhibits satisfactory superelasticity, as the texture is integrated by performing predetermined intermediate annealing and cold working, and performing heating for the final solutionizing treatment before quench-hardening with a slow temperature raise, and the Cu—Al—Mn-based alloy acquires predetermined crystalline orientation.

The shape of the Cu—Al—Mn-based alloy of the present invention is not limited particularly, and it may mean a product obtained into a predetermined shape, for example, sheet, wire (the term 'wire' in the present invention may include rod), or tube.

<Texture Controlling>

The Cu—Al—Mn-based superelastic alloy of the present invention has a texture in which when the crystalline orientation of the final finished material is measured in the working direction by electron back-scatter diffraction patterning, 70% or more of crystal grains among all the crystal grains have the deviation angle from the <001> orientation of the crystalline orientation existing in the range of 0° to 50°, and preferably 20° to 50°. More preferably, the Cu—Al—Mn-based alloy has a texture in which 80% or more of crystal grains among all the crystal grains, and particularly preferably 90% or more of crystal grains among all the crystal grains, have the deviation angle from the <001> orientation of the crystalline orientation existing in the range of 20° to 50°. It is because the characteristics are further enhanced by integration of the crystal grains. According to the present invention, satisfactory superelastic characteristics can be stably obtained, by controlling the texture to the specific state of integration. In this case, when the amount of transformation strain is 4 to 9%, stabilized shape memory characteristics and superelastic characteristics are exhibited. An example of the distribution of crystalline orientations of such a texture is schematically presented in the inverse pole figure of FIG. 1(*a*). As shown in FIG. 1(*a*), the area where the deviation angle from the <001> orientation is 0° to 50° is the hatched region and the checkered region in the figure, and the area wherein the deviation angle from the <001> orientation is 20° to 50° is only the checkered region in the diagram.

Further, it is preferable that in 50% or more of crystal grains among all the crystal grains, the deviation angle from the <101> orientation of the crystalline orientation exists in the range of 0° to 20°. It is more preferable that in 70% or more of crystal grains among all the crystal grains, the deviation angle from the <101> orientation of the crystalline orientation exists in the range of 0° to 20°. Even more preferably, the alloy has a texture in which, in 30% or more of crystal grains among all the crystal grains, the deviation angle from the <101> orientation of the crystalline orientation exists in the range of 0° to 10°; more preferably, in 50% or more of crystal grains among all the crystal grains, the deviation angle from the <101> orientation of the crystalline orientation exists in the range of 0° to 10°; and particularly preferably, in 70% of crystal grains among all the crystal grains, the deviation angle from the <101> orientation of the crystalline orientation exists in the range of 0° to 10°. In this case, the amount of transformation strain is 5 to 8%, and satisfactory shape memory characteristics and superelastic characteristics are more stably exhibited. An example of distribution of the crystalline orientation of such a texture is schematically shown in the inverse pole figure of FIG. 1(*b*).

In the inverse pole figure (crystalline orientation distribution diagram) of FIG. 1(*c*), the region in which the deviation angle from the <001> orientation is 0° to 50° (actually, 20° to 50°), and the deviation angle from the <101> orientation is 0° to 20°, and both of these conditions are satisfied (the hatched region and the checkered region in the diagram); and the region in which the deviation angle from the <001> orientation is 0° to 50° (actually, 20° to 50°), and the deviation angle from the <101> orientation is 0° to 10°, and both of these conditions are satisfied (only the checkered region in the diagram), are schematically illustrated.

The Cu—Al—Mn-based alloy of the present invention is an alloy having the recrystallized texture described above.

Further, the Cu—Al—Mn-based alloy of the present invention is substantially composed of a β single phase. Herein, the expression 'being substantially composed of a β single phase' means that the existence ratio of a phase other than the β phase, for example, an α phase, is generally 10% or less, and preferably 5% or less.

Figure 2D:
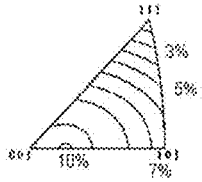
FIGS. 2(*a*) to 2(*c*) show the inverse pole figures (upper row and middle row) obtained by measuring the crystalline orientation in the working direction (RD) by EBSD in a case in which the intermediate annealing temperature was 450° C.

For example, an alloy of Cu-8.1 mass % Al-11.1 mass % Mn has a β (BCC) single phase at 900° C., but has two phases of an α (FCC) phase+a β phase at 700° C. or lower. It was found that when intermediate annealing at a temperature range that causes these two phase regions, and cold working at a working ratio of 30% or more are repeated, a recrystallized texture undergoes significant integration of crystalline orientations as a result of annealing within a predetermined temperature range. This is shown in FIG. 2. FIGS. 2(*a*) to 2(*c*) show the results of measuring the crystalline orientation in the working direction (RD) after a heat treatment at 900° and subsequent quench-hardening, by EBSD. As can be seen from the diagrams, the desired degree of integration is higher in FIG. 2(*a*) at an intermediate annealing temperature of 450° C., than in FIG. 2(*b*) at an intermediate annealing temperature of 550° C. or in FIG. 2(*c*) at an intermediate annealing temperature of 600° C. According to the present invention, it is more preferable if there are more crystal grains whose deviation angles from the <001> orientation of the crystalline orientation is in the range of 0° to 50°, and preferably in the range of 20° to 50°. Also, as the intermediate annealing temperature is lower as such, the frequency of existence of the <111> orientation is lowered. According to the present invention, it is more preferable if the frequency of existence of the <111> orientation is as lower as possible.

According to the present invention, the extent of integration to these <001> orientation and <101> orientation is measured by SEM-EBSD. A specific measurement method therefor is explained below.

After a tensile test for the evaluation of superelastic characteristics that will be described below, a portion of the gauge length is cut off and then embedded with an electroconductive resin, and the sample is subjected to vibration-type buffing (polishing). Measurement is carried out by an EBSD method in a measurement region having a size of about 400 μm×550 μm, under the conditions of a scan step of 5 μm. This measurement is carried out over nearly the entire length (25 mm) of the gauge length of the tensile test specimen. The crystalline orientations obtained from all of the measurement results using an OIM software (trade name, manufactured by TexSEM Laboratories, Inc.) are plotted on an inverse pole figure. As described above, the area of the atomic plane of crystal grains having a deviation angle from the <001> orientation of 0° to 50° (preferably, 20° to 50°), and the area of the atomic plane of crystal grains having a deviation angle from the <101> orientation of 0° to 20° (preferably, 0° to) 10°, are respectively determined, and the areas are divided by the total measured area, thereby, the proportion of the region in which the deviation angle from the <001> orientation is 0° to 50° (preferably, 20° to 50°) and the proportion of the region in which the deviation angle from the <101> orientation is 0° to 20° (preferably, 0° to 10°) are obtained.

In the technical art of the present invention, even though a large number of crystal grains exist in a random fashion without having the crystalline orientations aligned, if this is a bamboo texture, the average strain of the amounts of transformation strain of the various orientations may be obtained as superelasticity. In this case, consequently, the average strain may be of approximately the same extent as that of the transformation strain of <101> in the predetermined texture defined in the present invention. For example, even if it is the circumstance that only several crystal grains exist in a random fashion, superelastic strain close to 10% in average may be provided, and there may also be occasions in which this superelastic strain is about 3%.

Thus, the technical significance of employing a predetermined texture in the present invention is to prevent unevenness to exhibit these superelastic characteristics. That is, according to the present invention, when a predetermined texture is formed, superelastic characteristics or yield stress corresponding thereto is obtained stably. This is unpredictable from the conventional means.

(Method of Measuring Existence Frequency of Crystalline Orientation)

The Cu—Al—Mn-based alloy of the present invention is substantially composed of a β single phase, and has a recrystallized texture in which the crystalline orientation of the β single phase is aligned in the working direction. However, when the existence frequency of a crystalline orientation (a value representing the state of the crystalline orientation being aligned) of this crystal structure measured by electron back-scatter diffraction patterning is represented by f(g), the existence frequency can be determined by formula:

$$f(g)\cdot V=dV/dg$$

wherein V represents the volume of all of the crystal grains; g represents the crystalline orientation; and dV/dg represents the volume of the crystal grains included in a micro-orientation space dg in the crystalline orientation g.

The existence frequency of the crystalline orientation of the <101> direction in the working direction can be determined as described above. Herein, for example, the existence frequency of the <101> crystalline orientation in the working direction may be represented as "0" in a case in which there is absolutely no crystalline orientation in the working direction; as "1" in a case in which the crystalline orientation is completely random; and as "∞" in a case in which the crystalline orientations are perfectly aligned in the working direction. The existence frequency for the <001> crystalline orientation can also be determined in the same manner. As such, the existence frequency of the <101> orientation and the existence frequency of the <001> orientation were determined for the various samples of the Examples and the Comparative Examples given below.

(Regarding Integration of Crystalline Orientations)

The relationship between the existence frequencies of the <101> and <001> crystalline orientations and the like in the working direction, and the superelastic characteristics, can be considered as described below.

As the value of the existence frequency of the <101> crystalline orientation in the working direction is larger, the crystalline orientations are aligned in a particular direction; therefore, it is preferable in order to enhance the superelastic characteristics. On the contrary, if the existence frequency of the crystalline orientation in the <101> direction in the working direction is too small, the Cu—Al—Mn-based alloy of the present invention is deteriorated in superelastic characteristics. Thus, it is more preferable for the enhancement of the superelastic characteristics as the existence frequency of the crystalline orientation in the <001> direction is as smaller as possible. Of course, the same tendency is observed also for the shape memory characteristics.

In regard to the various orientations, <101> and <011> are equivalent to <110>, and <001> and <010> are equivalent to <100>.

<Method of Producing Cu—Al—Mn-based Superelastic Alloy>

Figure 4A:
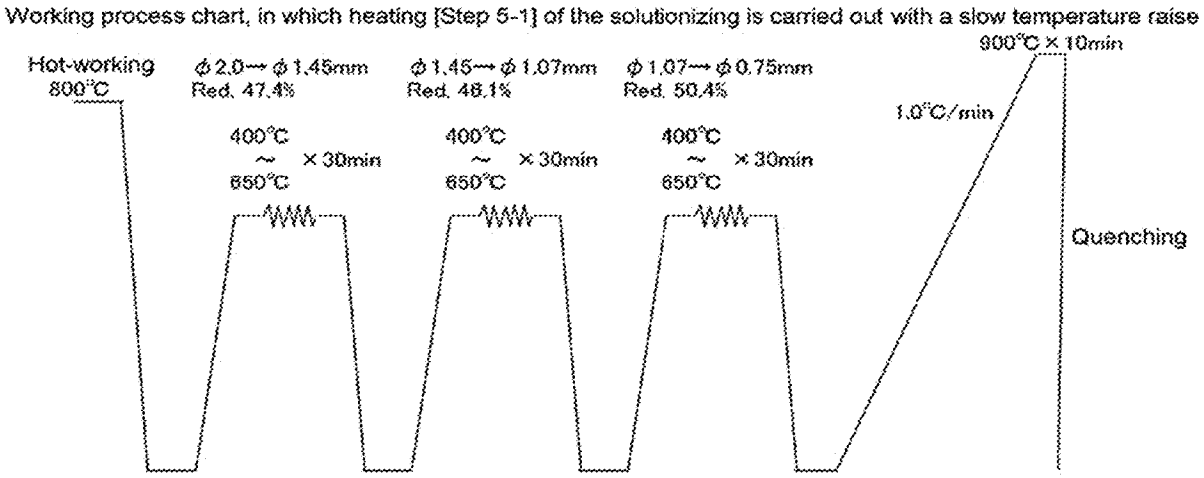
FIGS. 4(*a*) and 4(*b*) shows a representative example of a working process chart, while FIG. 4(*a*) is a chart presenting an example of the working process of the production method of the present invention of performing the heating [Step 5-1] of the heat treatment with a slow temperature raise at 1.0° C./min.
Figure 4B:
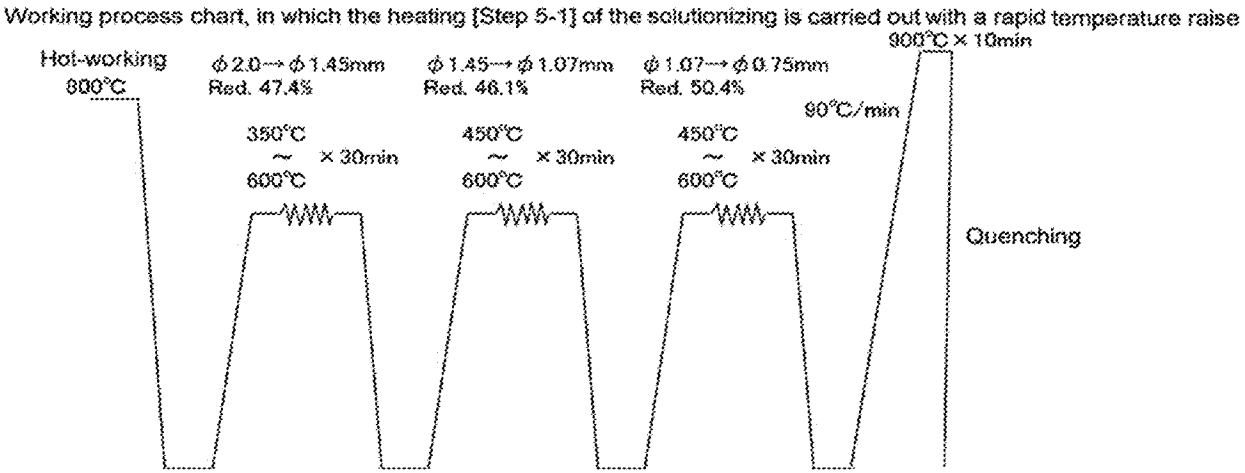

In regard to the Cu—Al—Mn-based superelastic copper base alloy of the present invention, a production process such as described below may be mentioned, in connection with the production conditions for obtaining a superelastic alloy which stably exhibits satisfactory superelastic characteristics such as described above. Further, a preferred example of the production process is illustrated in FIG. 4(*a*).

In the entire production process, particularly when the intermediate annealing temperature is set to the range of 400° C. to 600° C., and the cold-rolling ratio or the working ratio of cold-wire-drawing is set to the range of 30% or more, a Cu—Al—Mn-based alloy which stably exhibits satisfactory superelastic characteristics is obtained. In addition to this, it is preferable to control the rate of temperature raise for the heating to a predetermined slow range. Herein, the heating involves performing a solutionizing treatment achieved by first raising the temperature from room temperature and then rapidly cooling. Herein, it is preferable to slow the rate of temperature raise for the heating (in the present specification, this is referred to as slow temperature raise). The rate of temperature raise at the time of slow temperature raise is preferably 20° C./min or less, more preferably 5° C./min or less, even more preferably 0.2°/min to 3.3° C./min, and particularly preferably 1° C./min to 3.3° C./min. Further, in regard to the heating, cooling for the solutionizing after the heating is carried out by rapid cooling (so-called quench-hardening). This rapid cooling can be carried out by, for example, water-cooling of introducing the Cu—Al—Mn-based alloy of the present invention that has been subjected to the heating, into cooling water.

Preferably, a production process such as follows may be mentioned.

After melting and casting [Step 1] and hot working [Step 2] of hot rolling or hot forging, intermediate annealing [Step 3] at 400° C. to 600° C. for 1 minute to 120 minutes and then cold-rolling or cold-wire-drawing [Step 4] at a working ratio of 30% or higher are carried out. Herein, the intermediate annealing [Step 3] and the cold-rolling or cold-wire-drawing [Step 4] may be carried out once each in this order, or may be repeatedly carried out two or more times in this order. Then, heating [Step 5] is carried out.

The heating [Step 5] includes the steps of: heating [Step 5-1] of heating from room temperature to the heating temperature at a rate of temperature raise of generally 20° C./min or less, preferably 5° C./min or less, more preferably 0.2° C./min to 3.3° C./min, and particularly preferably 1° C./min to 3.3° C./min, maintaining at the heating temperature for 5 minutes to 120 minutes, and setting the heating temperature to the β single phase temperature range of 700° C. to 950° C. (preferably, 800° C. to 900° C.); and then rapid cooling [Step 5-2], for example, water cooling.

After the heating [Step 5], it is preferable to carry out age-heating [Step 6] at 80° C. to 250° C. for 5 to 60 minutes. If the aging temperature is too low, the β phase is unstable, and if the alloy is left to stand at room temperature, the martensite transformation temperature may change. On the contrary, if the aging temperature is higher than 250° C., precipitation of an α phase occurs, and the shape memory characteristics or superelasticity tends to lower conspicuously.

The crystalline orientations can be integrated more preferably, by repeatedly performing the intermediate annealing [Step 3] and the cold-rolling or cold-wire-drawing [Step 4]. The number of repetitions of the intermediate annealing [Step 3] and the cold-rolling or cold-wire-drawing [Step 4] is preferably two or more times, and more preferably 3 or more times. There are no particular limitations on the upper limit of this number of repetitions, but the number of repetitions is generally 10 times or less, and preferably 7 times or less. This is because as the number of repetitions of the intermediate annealing [Step 3] and the working [Step 4] is larger, the degree of integration toward the <101> orientation is increased, and the characteristics are enhanced.

Preferred conditions for the steps are as follows.

The intermediate annealing [Step 3] is carried out at 400° to 600° C. for 1 minute to 120 minutes. It is preferable that this intermediate annealing temperature be set to a lower temperature within this range; and the intermediate annealing temperature is preferably set to 450° C. to 550° C., and particularly preferably 450° C. to 500° C. The annealing time is preferably 1 minute to 120 minutes, and even if the influence of the sample size is considered, an annealing time of 120 minutes is sufficient for a round rod with diameter φ 20 mm.

For the cold-rolling or cold-wire-drawing [Step 4], it is preferable to carry out the step at a working ratio of 30% or higher. The working ratio is preferably 40% or higher, more preferably from 45 to 75%, and particularly preferably from 45 to 60%. Herein, the working ratio is a value defined by formula:

$$\text{Working ratio}(\%)=\{(A_1-A_2)/A_1\}\times 100$$

wherein $A_1$ represents the cross-sectional area ($mm^2$) obtained before cold-rolling or cold-wire-drawing; and $A_2$ represents the cross-sectional area ($mm^2$) obtained after cold-rolling or cold-wire-drawing.

In regard to the heating [Step 5], when heating is performed by the heating [Step 5-1], the rate of temperature raise up to the β single phase temperature range, e.g. 700° C. to 950° C., is generally 20° C./min or less, preferably 5° C./min or less, more preferably 0.2° C./min to 3.3° C./min, and particularly preferably 1° C./min to 3.3° C./min. When the rate of temperature raise at the heating [Step 5-1] is set to the slow rate defined as described above (slow temperature raise), changes in the crystalline orientation can be prevented.

The cooling speed at the time of rapid cooling [Step 5-2] is generally set to 30° C./sec or more, preferably 100° C./sec or more, and more preferably 1,000° C./sec or more.

It is preferable to perform the final optional age-heating [Step 6] generally at a temperature below 300° C., and preferably at 80° C. to 250° C., for 5 to 60 minutes.

<Composition of Cu—Al—Mn-based Superelastic Alloy>

The Cu—Al—Mn-based alloy of the present invention is formed of a copper alloy which has a β single phase at a high temperature, and a two-phase texture of β+α at a low temperature, and contains at least Al and Mn. The Cu—Al—Mn-based alloy of the present invention has a composition containing 3 to 10% by mass of Al and 5 to 20% by mass of Mn, with the balance being Cu and unavoidable impurities. If the content of elemental Al is too small, the β single phase cannot be formed, and if the content is too large, the alloy becomes very brittle. The content of elemental Al may vary depending onto the content of elemental Mn, but a preferred content of elemental Al is 7 to 9% by mass. When the alloy contains elemental Mn, the range of existence of the β phase extends to a lower Al-content side, and cold workability is markedly enhanced. Thus, forming work is made easier. If the amount of addition of elemental Mn is too small, satisfactory workability is not obtained, and the region of a β single phase cannot be formed. Also, if the amount of addition of elemental Mn is too large, sufficient shape recovery characteristics are not obtained. A preferred content of Mn is 8 to 13% by mass. The Cu—Al—Mn alloy having the above-described composition has high hot workability and cold workability, and enables to obtain a working ratio of 20 to 90% or higher in cold working. Thus, the alloy can be easily worked by forming into sheets and wires (rods), as well as fine wires, foils, pipes and the like that have been conventionally difficult to produce.

In addition to the essential alloying elements described above, the Cu—Al—Mn-based alloy of the present invention can further contain at least one selected from the group consisting of Co, Fe, Ti, V, Cr, Si, Nb, Mo, W, Sn, Mg, P, Be, Sb, Cd, As, Zr, Zn, B, C, Ag and misch metal. These elements make crystal grains finer while maintaining cold workability, and thus exhibit an effect of enhancing the physical strength of the Cu—Al—Mn-based alloy. The content in total of these elements is preferably 0.001 to 10% by mass, and particularly preferably 0.001 to 5% by mass. If the content of these elements is too large, the martensite transformation temperature is lowered, and the β single phase texture becomes unstable. Regarding these optional alloying elements, use can be made of the aforementioned elements that are generally used by being contained into copper-base alloys, for example, for the purpose of making crystal grains finer, strengthening of copper alloys.

Co, Fe and Sn are elements that are effective for strengthening of the matrix microstructure. Co makes the crystal grains coarse by forming CoAl; however, Co in an excess amount causes lowering of toughness of the alloy. A preferred content of Co is 0.001 to 2% by mass. A preferred content of Fe is 0.001 to 3% by mass. A preferred content of Sn is 0.001 to 1% by mass.

Ti is bonded to N and 0, which are inhibitory elements, and forms oxynitride. Also, Ti forms boride when added in combination with B, makes the crystal grains finer, and enhances strength. A preferred content of Ti is 0.001 to 2% by mass.

V, Nb, Mo and Zr have an effect of enhancing hardness, and enhance abrasion resistance. Further, since these elements are hardly solid-solubilized into the base, the elements precipitate as a β phase (bcc crystals), and are effective for the making crystal grains finer. Preferred contents of V, Nb, Mo and Zr are respectively 0.001 to 1% by mass.

Cr is an element effective for retaining abrasion resistance and corrosion resistance. A preferred content of Cr is 0.001 to 2% by mass. Si has an effect of enhancing corrosion resistance. A preferred content of Si is 0.001 to 2% by mass. W is hardly solid-solubilized into the base, and thus has an effect of precipitation strengthening. A preferred content of W is 0.001 to 1% by mass.

Mg eliminates N and O, which are inhibitory elements, fixes S that is an inhibitory element as sulfide, and has an effect of enhancing hot workability or toughness. Addition of a large amount of Mg brings about grain boundary segregation, and causes embrittlement. A preferred content of Mg is 0.001 to 0.5% by mass.

P acts as a de-acidifying agent, and has an effect of enhancing toughness. A preferred content of P is 0.01 to 0.5% by mass. Be, Sb, Cd, and As have an effect of strengthening the matrix microstructure. Preferred contents of Be, Sb, Cd and As are respectively 0.001 to 1% by mass.

Zn has an effect of raising the shape memory treatment temperature. A preferred content of Zn is 0.001 to 5% by mass. B and C have an effect of making the crystalline texture finer. Particularly, combined addition of Ti and Zr is preferred. Preferred contents of B and C are 0.001 to 0.5% by mass.

Ag has an effect of enhancing cold workability. A preferred content of Ag is 0.001 to 2% by mass. Misch metal has an effect of making crystal grains finer. A preferred content of misch metal is 0.001 to 5% by mass.

The superelastic Cu—Al—Mn-based alloy of the present invention preferably has a Ni content of 1% by mass or less, and more preferably 0.15% by mass or less, and it is particularly preferable that the alloy do not contain Ni. It is because if the alloy contains Ni in a large amount, texture controlling is easy, but the quench-hardening property previously explained is deteriorated.

<Physical Property>

The superelastic Cu—Al—Mn-based alloy of the present invention has the following physical properties.

Regarding the superelastic characteristics, the residual strain after 6% deformation is generally 1.0% or less, preferably 0.5% or less, and more preferably 0.2% or less.

The elongation (elongation at breakage) is generally 6% or more, preferably 8% or more, and more preferably 10% or more.

Further, the residual strain and elongation as the superelastic characteristics have no unevenness in the performance, even if specimens are cut out from at any sites from a same alloy and analyzed. Herein, the expression 'having unevenness' means that, in regard to the residual strain and elongation, for example, when twenty specimens are cut out from a same alloy and analyzed, one or more specimens have a residual strain value of more than 1.0%, or have an elongation value of less than 6%.

There are no particular limitations on the shape of the Cu—Al—Mn-based alloy of the present invention, and, for example, various shapes, such as a sheet and a wire (rod), can be employed. There are also no particular limitations on the sizes thereof, and, for example, in the case of a sheet, a size with a thickness of 0.1 mm to 15 mm can be employed, while in the case of a wire, a size with a diameter of 0.1 mm to 50 mm or a size with a diameter of 8 mm to 16 mm depending on the use, can be employed.

EXAMPLES

The present invention will be described in more detail based on examples given below, but the invention is not meant to be limited by these.

Example 1

Samples (specimen) of sheets were produced under the following conditions.

As the copper alloys that give the compositions indicated in Table 1-1 and Table 1-2, pure copper, pure Mn and pure Al were subjected to high frequency induction melting. The copper alloys thus melted were cooled, to obtain ingots having an external diameter of 80 mm×length of 300 mm. The ingots thus obtained were hot rolled at 800° C., and then those sheets having small thicknesses indicated in Table 2-1 to Table 2-4 were produced by performing intermediate annealing and cold-rolling once or repeatedly several times, under the conditions indicated in Table 2-1 to Table 2-4, according to the working process illustrated in FIG. 4(*a*) in Examples according to the present invention, and the working process illustrated in FIG. 4(*b*) in Comparative Examples, respectively. FIG. 4(*a*) and FIG. 4(*b*) are charts illustrating the respective processes of representative examples, and the temperature and time period of intermediate annealing, working ratio of cold working, wire diameters or sheet thicknesses before and after cold working, and the number of repetitions of the intermediate annealing and the cold-working were varied as indicated in Table 2-1 to Table 2-4. In Table 2-1 to Table 2-4, the working ratio for cold-rolling of each step is indicated in order, from the left side to the right side in the column of "cold working ratio (%)", as the working ratio of first step→working ratio of second step→working ratio of third step→ . . . . Also, the number of repetitions of those intermediate annealing and cold-rolling are indicated as "the number of cycles (rounds) of cold-working". Small specimens having a size of 150 mm in length×20 mm in width were cut out in parallel to the rolling direction from each of the thin sheets thus obtained, and the small specimens were subjected to a heat treatment according to the working process illustrated in FIG. 4(*a*) in Examples according to the present invention, and the working process illustrated in FIG. 4(*b*) in Comparative Examples, and then to rapid cooling by water cooling. Thus, a sample of a β (BCC) single phase was obtained. The respective samples were subjected to an age-heating at 200° C. for 15 minutes as necessary.

An optical microscope was used for structure observation, and EBSD was used for a crystalline orientation analysis. The evaluation of superelastic characteristics was carried out, by determining a stress-strain curve (S-S curve), by performing stress applied thereto and elimination through a tensile test, and thus the residual strain and elongation were determined and evaluated. The tensile test was carried out by cutting out twenty test pieces (N=20) from one specimen. The following test results include the maximum value among twenty values for the residual strain, and the minimum value among twenty values for the elongation. This is because it is intended to evaluate whether there is no unevenness in the exhibition of characteristics, and satisfactory characteristics are precisely and uniformly obtained in a stable manner.

The methods for tests and evaluations are described in detail below.

a. Recrystallized Texture Orientation

After a tensile test for the evaluation of superelastic characteristics that will be described below. A portion of the gauge length was cut off and then embedded in an electroconductive resin, and the sample was subjected to vibration-type buffing (polishing). Measurement was carried out by an EBSD method in a measurement region having a size of about 400 μm×550 μm under the conditions of a scan step of 5 μm. This measurement was carried out over nearly the entire length (25 mm) of the gauge length of the tensile test specimen. The crystalline orientations obtained from all of the measurement results, using an OIM software (trade name, manufactured by TexSEM Laboratories, Inc.), were plotted on an inverse pole figure. As described above, the areas of the atomic planes of crystal grains having deviation angles from the <001> orientation in the range of 0° to 50° and in the range of 20° to 50°, and the areas of the atomic planes of crystal grains having deviation angles from the <101> orientation in the range of 0° to 20° and in the range of 0° to 10° were respectively determined, and the areas were divided by the total measured area. Thereby, the proportion of the region in which the deviation angle from the <001> orientation was in the range of 0° to 50° and in the range of 20° to 50°, and the proportion of the region in which the deviation angle from the <101> orientation was in the range of 0° to 20° and in the range of 0° to 10° were obtained. In the tables, these are simply indicated as "recrystallized texture orientation".

In regard to the deviation angle from the <001> orientation, the case where the proportion (a) of a region having a deviation angle from this <001> orientation of 0° to 50° was 70% or more was considered satisfactory and was denoted as "B"; and the case in which the proportion was less than 70% was considered unacceptable and was denoted as "D".

In regard to the deviation angle from the <001> orientation, the case where the proportion (b) of a region having a deviation angle from this <001> orientation of 20° to 50° was 90% or more was considered excellent and was denoted as "A"; the case where the proportion was 80% or more but less than 90% was considered satisfactory and was denoted as "B"; the case where the proportion was 70% or more but less than 80% was considered acceptable and was denoted as "C"; and the case in which the proportion was less than 70% was considered unacceptable and was denoted as "D".

Further, in regard to the deviation angle from the <101> orientation, the case where the proportion (c) of a region having a deviation angle from this <101> orientation of 0° to 20° was 70% or more was considered satisfactory and was denoted as "B"; the case where the proportion was 50% or more but less than 70% was considered acceptable and was denoted as "C"; and the case where the proportion was less than 50% was considered unacceptable and was denoted as "D".

Further, the case where the proportion (d) of a region having a deviation angle from the <101> orientation of 0° to 10° was 70% or more was considered excellent and was denoted as "A"; the case where the proportion was 50% or more but less than 70% was considered satisfactory and was denoted as "B"; the case where the proportion was 30% or more but less than 50% was considered acceptable and was denoted as "C"; and the case where the proportion was less than 30% was considered unacceptable and was denoted as "D".

Figure 3:
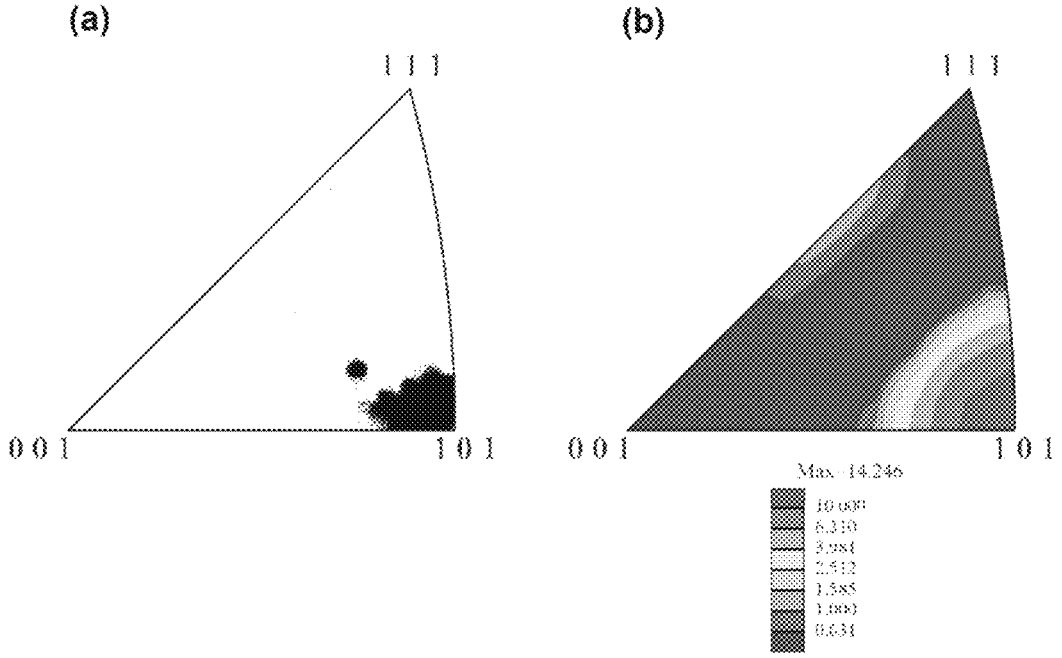
FIG. 3 is an inverse pole figure of the results of measuring the crystalline orientation in the working direction (RD) by EBSD, in a wire having a wire diameter of 0.75 mm, which was produced by performing three times of a combination of intermediate annealing, before the respective cold-wire-drawing, at an intermediate annealing temperature of 450° C. and three times of cold-wire-drawing at working ratios of 47.4%, 46.1% and 50.4%.

In regard to the wire of Example 12 described below, the results of measuring the crystalline orientation in the working direction (RD) by EBSD are presented in FIG. 3. As can be seen from the inverse pole figure of FIG. 3, this has the particularly preferred texture defined in the present invention.

Apart from this, for the samples of the Examples and Comparative Examples, the existence frequency of the <101> orientation and the existence frequency of the <001> orientation were measured by EBSD in the same manner as described above.

b. Superelastic Characteristics [Residual Strain (%) after 6% Deformation]

A stress-strain curve (S-S curve) was determined by performing a tensile test, and the residual strain was determined and evaluated.

Twenty test pieces each having a length of 150 mm were cut out from each of the specimens and supplied to the test. The residual strain after 6% deformation was determined from the stress-strain curve (S-S curve), and the values are presented in the tables.

Regarding the test conditions, a tensile test of alternately repeating strain loading and elimination by repeatedly loading predetermined strains of different levels over a gauge length of 25 mm, while temporarily increasing the amount of strain from 1 to 8% by 1% in each step, was carried out at a test rate of 2%/min. The cycle of strain loading used herein was as follows: 0 MPa (strain at zero load)→1%→0 MPa→2%→0 MPa→3%→0 MPa→4%→0 MPa→5%→0 MPa→6%→0 MPa→7%→0 MPa→8%→0 MPa.

Figure 5A:
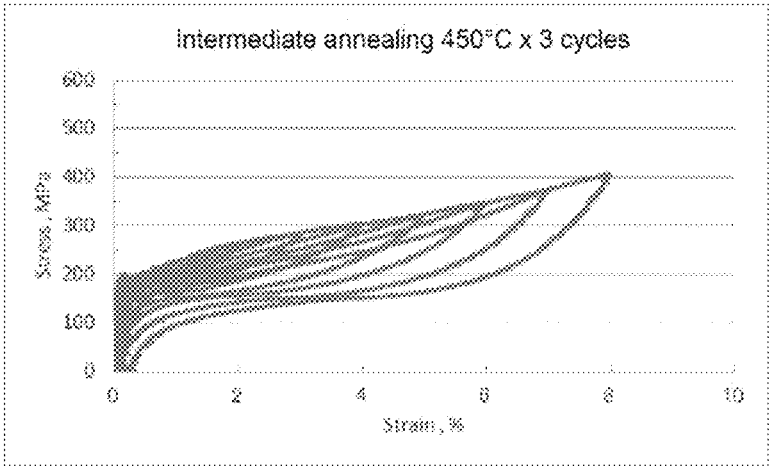
FIG. 5(*a*) is a stress-strain curve (S-S curve) showing the residual strain as the superelastic characteristics obtained by the process of FIG. 4(*a*).
Figure 5B:
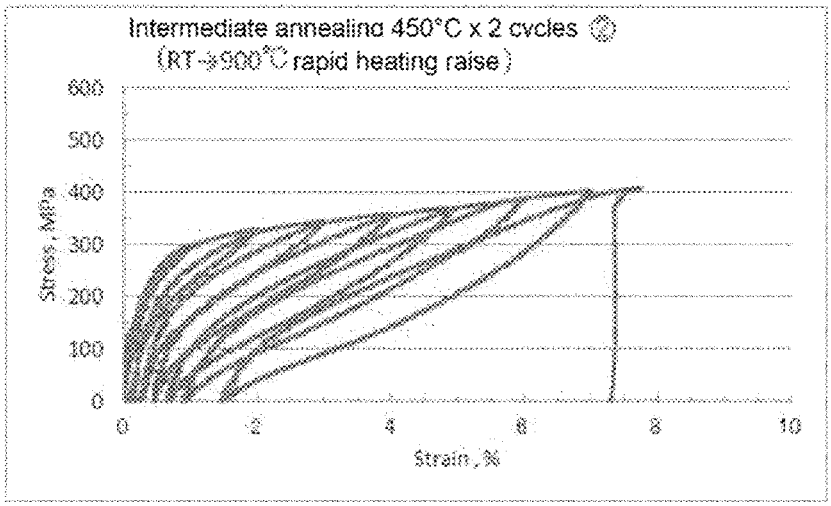

The case where the residual strain was 0.2% or less was considered to have excellent superelastic characteristics and was rated as "A"; the case where the residual strain was more than 0.2% but not more than 0.5% was considered to have satisfactory superelastic characteristics and was rated as "B"; the case where the residual strain was more than 0.5% but not more than 1.0% was considered to have acceptable superelastic characteristics and was rated as "C"; and the case where the residual strain was large such as more than 1.0% was considered to have unacceptable superelastic characteristics and was rated as For representative residual strains, stress-strain curve (S-S curve) is presented in FIG. 5. FIG. 5(*a*) shows an Example, which is a wire (Example 12) obtained by repeating the working process three times at an intermediate annealing temperature of 450° C.; and FIG. 5(*b*) shows a Comparative Example, which is a wire (Comparative Example not shown in the table) obtained by repeating the working process two times at an intermediate annealing temperature of 450° C.

c. Elongation (El) (%)

The elongation at breakage was measured according to the method defined in JIS H7103.

The case where the elongation was 10% or more was considered excellent and was denoted as "A"; the case where the elongation was 8% or more but less than 10% was considered satisfactory and was denoted as "B"; the case where the elongation was 6% or more but less than 8% was considered acceptable and was denoted as "C"; and the case where the elongation was less than 6% was considered poor and was denoted as "D".

d. Quench-hardening Sensitivity

For the quench-hardening sensitivity, the amount of precipitation of an α phase obtained when a sample was cooled at a cooling speed of 300° C./sec after a heating, was evaluated as the volume proportion based on an image analysis of SEM images.

The case where the volume proportion of the α phase was less than 10% was judged to be excellent in quench-hardening sensitivity and was denoted as "B"; and the case where the volume proportion was 10% or more was judged to be poor in quench-hardening sensitivity and was denoted as "D".

Example 2

A sample (specimen) of a wire (rod) was produced under the following conditions.

As the copper alloys that give the compositions indicated in Table 1-1 and Table 1-2, pure copper, pure Mn and pure Al were subjected to high frequency induction melting. The copper alloys thus melted were cooled, to obtain ingots having a diameter of 80 mm and a length of 300 mm. The ingots thus obtained were hot forged, to obtain round rods having a diameter of 20 mm.

These round rods were further subjected to (1) hot forging, or (2) cold-wire-drawing as necessary, and wires having the diameters indicated in Tables 2-1 to Table 2-4 were obtained as described below.

Similar to the cases of the sheets, wires having the diameters indicated in Table 2-1 to Table 2-4 were produced, by performing once or repeatedly several times intermediate annealing and cold-wire-drawing under the conditions indicated in Table 2-1 to Table 2-4, according to the working process illustrated in FIG. 4(*a*) in the Examples according to the present invention, and the working process illustrated in FIG. 4(*b*) in Comparative Examples. Before the wire-drawing into sizes, an intermediate annealing heat treatment was carried out at the intermediate annealing temperatures described in Table 2-1 to Table 2-4.

Two representative examples of working processes are illustrated below, together with the wire diameter and the working ratio.

(Wire-drawing Conditions 1)

Round rod diameter φ 18 mm×L 500 mm (forging finish)
→round rod diameter φ 14 mm×L mm (wire-drawing finish) (working ratio 40%)
→round rod diameter φ 10 mm×L mm (wire-drawing finish) (working ratio 49%)
→round rod diameter φ 7 mm×L mm (wire-drawing finish) (working ratio 51%)
→round rod diameter φ 5 mm×L mm (wire-drawing finish) (working ratio 49%)
→round rod diameter φ 4 mm×L mm (wire-drawing finish) (working ratio 36%)
→round rod diameter φ 3 mm×L mm (wire-drawing finish) (working ratio 44%)
→round rod diameter φ 2 mm×L mm (wire-drawing finish) (working ratio 56%)

Similar to the cases of the sheets, wires having the diameters indicated in Table 2-1 to Table 2-4 were produced, by performing once or repeatedly several times intermediate annealing and cold-wire-drawing under the conditions indicated in Table 2-1 to Table 2-4, according to the working process illustrated in FIG. 4(*a*) in the Examples according to the present invention, and the working process illustrated in FIG. 4(*b*) in Comparative Examples. Before the wire-drawing into sizes, an intermediate annealing heat treatment was carried out at the intermediate annealing temperatures described in Table 2-1 to Table 2-4.

(Wire-drawing Conditions 2)

A rough wire having a diameter of 2.0 mm was obtained by hot forging and wire-drawing. For this rough wire, similar to the cases of the sheets described above, wires having the diameters indicated in Table 2-1 to Table 2-4, by performing once or repeatedly several times intermediate annealing and cold-wire-drawing under the conditions indicated in Table 2-1 to Table 2-4, according to the working process illustrated in FIG. 4(*a*) in the Examples according to the present invention, and the working process illustrated in FIG. 4(*b*) in the Comparative Examples. Before the wire-drawing into sizes, an intermediate annealing heat treatment was carried out at the intermediate annealing temperatures described in Table 2-1 to Table 2-4.

Intermediate annealing temperature: as described in Table 2-1 to Table 2-4

The number of working cycles of intermediate annealing→cold-wire-drawing: as described in Table 2-1 to Table 2-4

Herein, the intermediate annealing conditions and the working ratio of cold-wire-drawing were, for example, as follows.

First intermediate annealing: 30 minutes at the intermediate annealing temperature described above →first cold-wire-drawing:working ratio 47.4% (wire diameter 2.0 mm→1.45 mm)

→second intermediate annealing: 30 minutes at the same intermediate annealing temperature as that of the first intermediate annealing →second cold-wire-drawing:working ratio 46.1% (wire diameter 1.45 mm→1.07 mm)

→third intermediate annealing: 30 minutes at the same intermediate annealing temperature as the first and second intermediate annealing →third cold-wire-drawing:working ratio 50.4% (wire diameter 1.07 mm→0.75 mm)

The second and third heat treatments and workings were carried out in some cases, and were not carried out in other cases.

Further, wires having desired wire diameters were produced through the same working processes, by appropriately changing the working ratio or the wire diameter as described in Table 2-1 to Table 2-4 from the two wire-drawing conditions described above.

Separately, the sheets and wires of Comparative Examples as described in Table 2-1 to Table 2-4 were obtained in the same manner, except that the temperature raise in the heat treatment [Step 5-1] was carried out by rapid temperature raise, such as at a ratio of 30° C./min or 90° C./min. It was confirmed by EBSD that these alloys did not have the predetermined texture defined in the present invention.

As another Comparative Examples, the wires described in Table 2-1 to Table 2-4 were obtained in the same manner, using a copper alloy containing Ni at a high content that was out of the range defined in the present invention, as described in Table 1-1 and Table 1-2. It was confirmed that these alloys were poor in superelastic characteristics after quench-hardening.

For the Cu—Al—Mn-based alloy wires thus obtained, characteristics were tested and evaluated in the same manner as in the cases of the sheets.

The results are shown in Tables 3-1 to 3-4.

TABLE 1-1

| Alloy No. | Alloying elements (mass %) Al | Mn | Others | Remarks |
|---|---|---|---|---|
| 1 | 8.1 | 10.7 | — | This invention |
| 2 | 8.1 | 11.1 | — | |
| 3 | 7.6 | 8.7 | — | |
| 4 | 8.7 | 8.8 | — | |
| 5 | 7.6 | 12.7 | — | |
| 6 | 8.7 | 12.7 | — | |
| 7 | 8.1 | 10.2 | Co 0.5 | |
| 8 | 8.0 | 9.0 | Ni 1 | |
| 9 | 8.1 | 10.2 | Ni 0.15 | |
| 10 | 6.2 | 19.9 | — | |
| 11 | 3.1 | 19.9 | — | |
| 12 | 9.9 | 5.1 | — | |
| 13 | 8.0 | 9.0 | Ni 2 | Comparative |
| 14 | 8.0 | 9.0 | Ni 2, Fe 0.5 | example |

Note:
'—' means not contained
The balance is Cu and the unavoidable impurities.

TABLE 1-2

| Alloy No. | Alloying elements (mass %) Al | Mn | Fe | Ti | V | Cr | Si | Sn | Zn | B | C | Pr | Nd | Remarks |
|---|---|---|---|---|---|---|---|---|---|---|---|---|---|---|
| 15 | 8.1 | 10.2 | 0.5 | — | — | — | — | — | — | — | — | — | — | This |
| 16 | 8.1 | 10.2 | — | 0.5 | — | — | — | — | — | — | — | — | — | invention |
| 17 | 8.1 | 10.2 | — | — | 0.5 | — | — | — | — | — | — | — | — | |
| 18 | 8.1 | 10.2 | — | — | — | 0.5 | — | 0.1 | — | 0.003 | — | — | — | |
| 19 | 8.1 | 10.2 | — | 0.3 | — | — | 0.05 | — | — | — | 0.003 | — | — | |
| 20 | 8.1 | 10.2 | — | — | 0.1 | — | — | 0.5 | — | — | — | — | — | |
| 21 | 8.1 | 10.2 | — | — | 0.1 | — | — | — | 0.5 | — | — | — | — | |
| 22 | 8.1 | 10.2 | — | — | — | — | — | — | — | — | — | 0.03 | 0.01 | |
| 23 | 8.1 | 10.2 | — | — | — | 0.4 | — | 0.1 | — | — | — | — | — | |
| 24 | 8.1 | 10.2 | — | 0.2 | — | 0.3 | — | — | — | — | — | — | — | |

Note:
'—' means not contained
The balance is Cu and the unavoidable impurities

TABLE 2-1

| Remarks | Alloy No. | Temp. at inter anneal (° C.) | Time at inter anneal (min) | Cold-working ratio (%) | Shape of sample | Size of sample (mm) | The number of cycles at cold-working (times) | Heating speed to β phase temp. in heating (° C./min) |
|---|---|---|---|---|---|---|---|---|
| Ex 1 | 1 | 400 | 30 | 47.4 | Wire | 1.45 | 1 | 1.0 |
| Ex 2 | 1 | 400 | 30 | 47.4 + 46.1 | Wire | 1.07 | 2 | 1.0 |
| Ex 3 | 1 | 400 | 30 | 47.4 + 46.1 + 50.4 | Wire | 0.75 | 3 | 1.0 |
| Ex 4 | 1 | 400 | 30 | 50 | Sheet | 2 | 1 | 3.3 |
| Ex 5 | 1 | 400 | 30 | 50 + 50 | Sheet | 1 | 2 | 3.3 |
| Ex 6 | 1 | 400 | 30 | 50 + 50 + 50 | Sheet | 0.5 | 3 | 3.3 |
| Ex 7 | 1 | 400 | 30 | 50 + 50 + 50 | Sheet | 0.5 | 3 | 5.0 |
| Ex 8 | 1 | 400 | 30 | 50 + 50 + 50 | Sheet | 0.5 | 3 | 20 |
| Ex 9 | 1 | 450 | 30 | 47.4 | Wire | 1.45 | 1 | 0.2 |
| Ex 10 | 1 | 450 | 30 | 47.4 | Wire | 1.45 | 1 | 1.0 |
| Ex 11 | 1 | 450 | 30 | 47.4 + 46.1 | Wire | 1.07 | 2 | 1.0 |
| Ex 12 | 1 | 450 | 30 | 47.4 + 46.1 + 50.4 | Wire | 0.75 | 3 | 1.0 |
| Ex 13 | 7 | 450 | 30 | 47.4 + 46.1 + 50.4 | Wire | 0.75 | 3 | 1.0 |
| Ex 14 | 8 | 450 | 30 | 47.4 + 46.1 + 50.4 | Wire | 0.75 | 3 | 1.0 |
| Ex 15 | 1 | 450 | 30 | 40 + 49 + 51 + 49 | Wire | 5 | 4 | 1.0 |
| Ex 16 | 1 | 450 | 30 | 40 + 49 + 51 + 49 + 36 + 44 + 56 | Wire | 2 | 7 | 1.0 |
| Ex 17 | 1 | 450 | 30 | 50 | Sheet | 2 | 1 | 3.3 |
| Ex 18 | 1 | 450 | 30 | 50 + 50 | Sheet | 1 | 2 | 3.3 |
| Ex 19 | 1 | 450 | 30 | 50 + 50 + 50 | Sheet | 0.5 | 3 | 3.3 |
| Ex 20 | 1 | 450 | 30 | 47.4 | Wire | 1.45 | 1 | 3.3 |
| Ex 21 | 1 | 450 | 30 | 47.4 | Wire | 1.45 | 1 | 20 |
| Ex 22 | 2 | 500 | 30 | 50 | Sheet | 2 | 1 | 3.3 |
| Ex 23 | 2 | 500 | 30 | 50 + 50 | Sheet | 1 | 2 | 3.3 |
| Ex 24 | 2 | 500 | 30 | 50 + 50 + 50 | Sheet | 0.5 | 3 | 3.3 |

Notes:
'Temp. at inter anneal (° C.)' means 'Temperature at intermediate annealing (° C.)';
'Time at inter anneal (min)' means 'Time period at intermediate annealing (min)';
'Size of samples (mm)' means 'Size of samples, sheet thickness or wire diameter (mm)';
'Heating speed to β phase temp. in heating (° C./min)' means 'Temperature raise speed to β phase temperature in heating (° C./min)';
and 'Ex' means 'Example according to this invention'

TABLE 2-2

| Remarks | Alloy No. | Temp. at inter anneal (° C.) | Time at inter anneal (min) | Cold-working ratio (%) | Shape of sample | Size of sample (mm) | The number of cycles at cold-working (times) | Heating speed to β phase temp. in heating (° C./min) |
|---|---|---|---|---|---|---|---|---|
| Ex 25 | 2 | 550 | 30 | 50 + 50 + 50 | Sheet | 0.5 | 3 | 1.0 |
| Ex 26 | 1 | 550 | 30 | 47.4 | Wire | 1.45 | 1 | 1.0 |
| Ex 27 | 1 | 550 | 30 | 47.4 + 46.1 | Wire | 1.07 | 2 | 1.0 |
| Ex 28 | 1 | 550 | 30 | 47.4 + 46.1 + 50.4 | Wire | 0.75 | 3 | 1.0 |
| Ex 29 | 3 | 550 | 30 | 47.4 + 46.1 + 50.4 | Wire | 0.75 | 3 | 1.0 |
| Ex 30 | 4 | 550 | 30 | 47.4 + 46.1 + 50.4 | Wire | 0.75 | 3 | 1.0 |
| Ex 31 | 5 | 550 | 30 | 47.4 + 46.1 + 50.4 | Wire | 0.75 | 3 | 1.0 |
| Ex 32 | 6 | 550 | 30 | 47.4 + 46.1 + 50.4 | Wire | 0.75 | 3 | 1.0 |
| Ex 33 | 7 | 550 | 30 | 47.4 + 46.1 + 50.4 | Wire | 0.75 | 3 | 1.0 |
| Ex 34 | 8 | 550 | 30 | 47.4 + 46.1 + 50.4 | Wire | 0.75 | 3 | 1.0 |
| Ex 35 | 9 | 550 | 30 | 47.4 + 46.1 + 50.4 | Wire | 0.75 | 3 | 1.0 |
| Ex 36 | 2 | 550 | 30 | 50 | Sheet | 2 | 1 | 3.3 |
| Ex 37 | 2 | 550 | 30 | 50 + 50 | Sheet | 1 | 2 | 3.3 |
| Ex 38 | 2 | 550 | 30 | 50 + 50 + 50 | Sheet | 0.5 | 3 | 3.3 |
| Ex 39 | 1 | 550 | 30 | 47.4 | Wire | 1.45 | 1 | 20 |
| Ex 40 | 1 | 600 | 10 | 47.4 + 46.1 | Wire | 1.07 | 2 | 1.0 |
| Ex 41 | 1 | 600 | 5 | 47.4 + 46.1 | Wire | 1.07 | 2 | 1.0 |
| Ex 42 | 1 | 600 | 1 | 47.4 + 46.1 | Wire | 1.07 | 2 | 1.0 |
| Ex 43 | 1 | 600 | 120 | 40 + 49 | Wire | 10 | 2 | 1.0 |
| Ex 44 | 1 | 600 | 90 | 40 + 49 | Wire | 10 | 2 | 1.0 |
| Ex 45 | 1 | 600 | 60 | 40 + 49 | Wire | 10 | 2 | 1.0 |
| Ex 46 | 2 | 600 | 30 | 50 + 50 | Sheet | 1 | 2 | 3.3 |
| Ex 47 | 1 | 600 | 30 | 30 | Wire | 16.7 | 1 | 3.3 |
| Ex 48 | 1 | 600 | 30 | 75 | Wire | 1 | 1 | 3.3 |
| Ex 49 | 2 | 600 | 30 | 50 | Sheet | 2 | 1 | 5.0 |
| Ex 50 | 1 | 600 | 30 | 47.4 | Wire | 1.45 | 1 | 20.0 |

TABLE 2-3

| Remarks | Alloy No. | Temp. at inter anneal (° C.) | Time at inter anneal (min) | Cold-working ratio (%) | Shape of sample | Size of sample (mm) | The number of cycles at cold-working (times) | Heating speed to β phase temp. in heating (° C./min) |
|---|---|---|---|---|---|---|---|---|
| Ex 51 | 1 | 600 | 30 | 50 + 50 + 50 | Sheet | 0.5 | 3 | 3.3 |
| Ex 52 | 3 | 600 | 30 | 50 + 50 + 50 | Sheet | 0.5 | 3 | 3.3 |
| Ex 53 | 6 | 600 | 30 | 50 + 50 + 50 | Sheet | 0.5 | 3 | 3.3 |
| Ex 54 | 10 | 600 | 30 | 50 + 50 + 50 | Sheet | 0.5 | 3 | 3.3 |
| Ex 55 | 11 | 600 | 30 | 50 + 50 + 50 | Sheet | 0.5 | 3 | 3.3 |
| Ex 56 | 12 | 600 | 30 | 50 + 50 + 50 | Sheet | 0.5 | 3 | 3.3 |
| Ex 57 | 15 | 600 | 30 | 50 + 50 + 50 | Sheet | 0.5 | 3 | 3.3 |
| Ex 58 | 16 | 600 | 30 | 50 + 50 + 50 | Sheet | 0.5 | 3 | 3.3 |
| Ex 59 | 17 | 600 | 30 | 50 + 50 + 50 | Sheet | 0.5 | 3 | 3.3 |
| Ex 60 | 18 | 600 | 30 | 50 + 50 + 50 | Sheet | 0.5 | 3 | 3.3 |
| Ex 61 | 19 | 600 | 30 | 50 + 50 + 50 | Sheet | 0.5 | 3 | 3.3 |
| Ex 62 | 20 | 600 | 30 | 50 + 50 + 50 | Sheet | 0.5 | 3 | 3.3 |
| Ex 63 | 21 | 600 | 30 | 50 + 50 + 50 | Sheet | 0.5 | 3 | 3.3 |
| Ex 64 | 22 | 600 | 30 | 50 + 50 + 50 | Sheet | 0.5 | 3 | 3.3 |
| Ex 65 | 23 | 600 | 30 | 50 + 50 + 50 | Sheet | 0.5 | 3 | 3.3 |
| Ex 66 | 24 | 600 | 30 | 50 + 50 + 50 | Sheet | 0.5 | 3 | 3.3 |

TABLE 2-4

| Remarks | Alloy No. | Temp. at inter anneal (° C.) | Time at inter anneal (min) | Cold-working ratio (%) | Shape of sample | Size of sample (mm) | The number of cycles at cold-working (times) | Heating speed to β phase temp. in heating (° C./min) |
|---|---|---|---|---|---|---|---|---|
| C Ex 1 | 1 | 350 | 30 | 47.4 | Wire | 1.45 | 1 | — |
| C Ex 2 | 1 | 375 | 30 | 47.4 | Wire | 1.45 | 1 | 1.0 |
| C Ex 3 | 13 | 450 | 30 | 47.4 + 46.1 + 50.4 | Wire | 0.75 | 3 | 1.0 |
| C Ex 4 | 14 | 450 | 30 | 47.4 + 46.1 + 50.4 | Wire | 0.75 | 3 | 1.0 |
| C Ex 5 | 1 | 450 | 30 | 47.4 + 46.1 + 50.4 | Wire | 0.75 | 3 | 30 |
| C Ex 6 | 1 | 450 | 30 | 47.4 + 46.1 + 50.4 | Wire | 0.75 | 3 | 90 |
| C Ex 7 | 2 | 500 | 30 | 50 + 50 + 50 | Sheet | 0.5 | 3 | 90 |
| C Ex 8 | 2 | 500 | 30 | 0 | Wire | 20 | 0 | 3.3 |
| C Ex 9 | 2 | 500 | 30 | 27 | Wire | 17.1 | 1 | 3.3 |
| C Ex 10 | 2 | 500 | 30 | 27 + 27 | Wire | 14.6 | 2 | 3.3 |
| C Ex 11 | 2 | 500 | 30 | 27 + 27 + 27 | Wire | 12.5 | 3 | 3.3 |
| C Ex 12 | 2 | 500 | 30 | 50 + 50 + 50 | Sheet | 0.5 | 3 | 90 |
| C Ex 13 | 2 | 550 | 30 | 50 + 50 + 50 | Sheet | 0.5 | 3 | 90 |
| C Ex 14 | 1 | 550 | 30 | 47.4 + 46.1 | Wire | 1.07 | 2 | 90 |
| C Ex 15 | 1 | 600 | 30 | 40 + 49 | Wire | 10 | 2 | 90 |
| C Ex 16 | 1 | 600 | 30 | 40 + 49 + 51 | Sheet | 7 | 3 | 90 |
| C Ex 17 | 2 | 600 | 30 | 50 | Sheet | 2 | 1 | 90 |
| C Ex 18 | 3 | 600 | 30 | 50 + 50 | Sheet | 1 | 2 | 90 |
| C Ex 19 | 1 | 600 | 30 | 50 + 50 + 50 | Sheet | 0.5 | 3 | 90 |
| C Ex 20 | 2 | 600 | 30 | 50 + 50 + 50 | Sheet | 0.5 | 3 | 90 |
| C Ex 21 | 2 | 650 | 30 | 50 | Sheet | 2 | 1 | 5.0 |
| C Ex 22 | 2 | 650 | 30 | 50 + 50 + 50 | Sheet | 0.5 | 3 | 5.0 |
| C Ex 23 | 1 | 650 | 30 | 47.4 + 46.1 | Wire | 1.07 | 2 | 1.0 |

Note:
'—' means not conducted; and
'C Ex' means 'Comparative Example'

TABLE 3-1

| Remarks | Deviation angle of 0° to 50° from <001> orientation | Deviation angle of 20° to 50° from <001> orientation | Deviation angle of 0° to 20° from <101> orientation | Deviation angle of 0° to 10° from <101> orientation | Existence frequency of <101> orientation | Existence frequency of <001> orientation | Superelastic property [residual strain after 6% deformation] | Superelastic property [residual strain after 6% deformation] | El | El | Quench-hardening sensitivity [α phase occupied ratio] | Quench-hardening sensitivity [α phase occupied ratio] |
|---|---|---|---|---|---|---|---|---|---|---|---|---|
| Ex 1 | B | A | C | C | 6.9 | >1.0 | B | 0.38% | A | 10.9% | B | 0.11% |
| Ex 2 | B | A | C | C | 6.3 | >1.0 | B | 0.26% | A | 11.6% | B | 0.12% |
| Ex 3 | B | A | C | C | 8.0 | >1.0 | B | 0.22% | A | 12.5% | B | 0.15% |

TABLE 3-1-continued

| Remarks | Deviation angle of 0° to 50° from <001> orientation | Deviation angle of 20° to 50° from <001> orientation | Deviation angle of 0° to 20° from <101> orientation | Deviation angle of 0° to 10° from <101> orientation | Existence frequency of <101> orientation | Existence frequency of <001> orientation | Superelastic property [residual strain after 6% deformation] | Superelastic property [residual strain after 6% deformation] | El | El | Quench-hardening sensitivity [α phase occupied ratio] | Quench-hardening sensitivity [α phase occupied ratio] |
|---|---|---|---|---|---|---|---|---|---|---|---|---|
| Ex 4 | B | A | C | C | 7.7 | >1.0 | B | 0.34% | A | 12.2% | B | 0.11% |
| Ex 5 | B | A | C | C | 6.9 | >1.0 | B | 0.24% | A | 12.5% | B | 0.08% |
| Ex 6 | B | A | C | C | 7.3 | >1.0 | B | 0.21% | A | 13.5% | B | 0.12% |
| Ex 7 | B | B | C | C | 5.5 | >1.0 | C | 0.66% | B | 8.8% | B | 0.16% |
| Ex 8 | B | C | C | C | 3.0 | >1.0 | C | 0.95% | C | 6.4% | B | 0.16% |
| Ex 9 | B | A | B | B | 13.7 | >1.0 | A | 0.12% | A | 14.0% | B | 0.17% |
| Ex 10 | B | A | B | B | 14.2 | >1.0 | A | 0.11% | A | 13.2% | B | 0.13% |
| Ex 11 | B | A | B | A | 13.5 | >1.0 | A | 0.09% | A | 13.9% | B | 0.19% |
| Ex 12 | B | A | B | A | 14.2 | >1.0 | A | 0.08% | A | 13.3% | B | 0.06% |
| Ex 13 | B | A | B | A | 13.7 | >1.0 | A | 0.08% | A | 14.3% | B | 0.08% |
| Ex 14 | B | A | B | A | 13.6 | >1.0 | A | 0.09% | A | 13.1% | B | 1.50% |
| Ex 15 | B | A | B | A | 14.9 | >1.0 | A | 0.05% | A | 12.9% | B | 0.12% |
| Ex 16 | B | A | B | A | 13.7 | >1.0 | A | 0.08% | A | 14.2% | B | 0.13% |
| Ex 17 | B | A | B | B | 14.3 | >1.0 | A | 0.13% | A | 12.1% | B | 0.14% |
| Ex 18 | B | A | B | A | 13.1 | >1.0 | A | 0.06% | A | 13.9% | B | 0.12% |
| Ex 19 | B | A | B | A | 14.5 | >1.0 | A | 0.08% | A | 13.3% | B | 0.14% |
| Ex 20 | B | A | B | B | 13.2 | >1.0 | A | 0.14% | A | 12.3% | B | 0.16% |
| Ex 21 | B | C | B | B | 10.9 | >1.0 | C | 0.90% | C | 7.8% | B | 0.16% |
| Ex 22 | B | A | B | B | 14.7 | >1.0 | A | 0.18% | A | 12.1% | B | 0.17% |
| Ex 23 | B | A | B | A | 14.5 | >1.0 | A | 0.08% | A | 14.4% | B | 0.11% |
| Ex 24 | B | A | B | A | 13.4 | >1.0 | A | 0.07% | A | 14.3% | B | 0.19% |

TABLE 3-2

| Remarks | Deviation angle of 0° to 50° from <001> orientation | Deviation angle of 20° to 50° from <001> orientation | Deviation angle of 0° to 20° from <101> orientation | Deviation angle of 0° to 10° from <101> orientation | Existence frequency of <101> orientation | Existence frequency of <001> orientation | Superelastic property [residual strain after 6% deformation] | Superelastic property [residual strain after 6% deformation] | El | El | Quench-hardening sensitivity [α phase occupied ratio] | Quench-hardening sensitivity [α phase occupied ratio] |
|---|---|---|---|---|---|---|---|---|---|---|---|---|
| Ex 25 | B | A | C | B | 11.9 | >1.0 | B | 0.21% | A | 11.8% | B | 0.13% |
| Ex 26 | B | A | C | B | 11.1 | >1.0 | B | 0.33% | A | 12.1% | B | 0.16% |
| Ex 27 | B | A | C | B | 10.4 | >1.0 | B | 0.31% | A | 12.4% | B | 0.13% |
| Ex 28 | B | A | C | B | 11.7 | >1.0 | B | 0.23% | A | 11.5% | B | 0.11% |
| Ex 29 | B | A | C | B | 10.8 | >1.0 | B | 0.25% | A | 12.7% | B | 0.10% |
| Ex 30 | B | A | C | B | 11.0 | >1.0 | B | 0.23% | A | 10.7% | B | 0.14% |
| Ex 31 | B | A | C | B | 10.2 | >1.0 | B | 0.24% | A | 12.9% | B | 0.12% |
| Ex 32 | B | A | C | B | 11.6 | >1.0 | B | 0.26% | A | 10.6% | B | 0.13% |
| Ex 33 | B | A | C | B | 11.7 | >1.0 | B | 0.23% | A | 11.7% | B | 0.07% |
| Ex 34 | B | A | C | B | 11.3 | >1.0 | B | 0.21% | A | 13.4% | B | 1.40% |
| Ex 35 | B | A | C | B | 11.3 | >1.0 | B | 0.24% | A | 12.7% | B | 0.35% |
| Ex 36 | B | A | C | B | 11.7 | >1.0 | B | 0.39% | A | 11.8% | B | 0.12% |
| Ex 37 | B | A | C | B | 11.9 | >1.0 | B | 0.25% | A | 12.8% | B | 0.18% |
| Ex 38 | B | A | C | B | 10.6 | >1.0 | B | 0.26% | A | 11.8% | B | 0.06% |
| Ex 39 | B | C | C | B | 6.6 | >1.0 | C | 0.95% | C | 7.7% | B | 0.18% |
| Ex 40 | B | A | C | C | 7.9 | >1.0 | B | 0.35% | A | 11.7% | B | 0.20% |
| Ex 41 | B | A | C | C | 7.8 | >1.0 | B | 0.33% | A | 11.6% | B | 0.16% |
| Ex 42 | B | A | C | C | 7.0 | >1.0 | B | 0.34% | A | 11.4% | B | 0.13% |
| Ex 43 | B | A | C | C | 6.9 | >1.0 | B | 0.36% | A | 11.6% | B | 0.08% |
| Ex 44 | B | A | C | C | 6.2 | >1.0 | B | 0.32% | A | 11.5% | B | 0.13% |
| Ex 45 | B | A | C | C | 6.3 | >1.0 | B | 0.31% | A | 11.3% | B | 0.15% |
| Ex 46 | B | A | C | C | 6.1 | >1.0 | B | 0.39% | A | 12.1% | B | 0.10% |
| Ex 47 | B | A | C | C | 6.9 | >1.0 | B | 0.40% | A | 11.3% | B | 0.16% |
| Ex 48 | B | A | C | C | 7.3 | >1.0 | B | 0.42% | A | 11.1% | B | 0.16% |
| Ex 49 | B | B | C | C | 4.6 | >1.0 | C | 0.69% | B | 9.9% | B | 0.16% |
| Ex 50 | B | C | C | C | 1.8 | 1.3 | C | 0.95% | C | 6.3% | B | 0.12% |

TABLE 3-3

| Remarks | Deviation angle of 0° to 50° from <001> orientation | Deviation angle of 20° to 50° from <001> orientation | Deviation angle of 0° to 20° from <101> orientation | Deviation angle of 0° to 10° from <101> orientation | Existence frequency of <101> orientation | Existence frequency of <001> orientation | Superelastic property [residual strain after 6% deformation] | Superelastic property [residual strain after 6% deformation] | El | El | Quench-hardening sensitivity [α phase occupied ratio] | Quench-hardening sensitivity [α phase occupied ratio] |
|---|---|---|---|---|---|---|---|---|---|---|---|---|
| Ex 51 | B | A | C | C | 6.8 | >1.0 | B | 0.22% | A | 12.2% | B | 0.16% |
| Ex 52 | B | A | C | C | 6.8 | >1.0 | B | 0.22% | A | 12.2% | B | 0.16% |
| Ex 53 | B | A | C | C | 6.8 | >1.0 | B | 0.22% | A | 12.2% | B | 0.16% |
| Ex 54 | B | A | C | C | 6.2 | >1.0 | C | 0.89% | A | 11.5% | B | 0.22% |
| Ex 55 | B | A | C | C | 5.9 | >1.0 | C | 0.92% | A | 10.6% | B | 0.19% |
| Ex 56 | B | A | C | C | 6.7 | >1.0 | C | 0.84% | C | 6.5% | B | 0.26% |
| Ex 57 | B | A | C | C | 6.2 | >1.0 | B | 0.31% | A | 13.5% | B | 0.12% |
| Ex 58 | B | A | C | C | 6.5 | >1.0 | B | 0.35% | A | 14.5% | B | 0.15% |
| Ex 59 | B | A | C | C | 6.3 | >1.0 | B | 0.36% | A | 14.1% | B | 0.13% |
| Ex 60 | B | A | C | C | 6.7 | >1.0 | B | 0.34% | A | 14.6% | B | 0.16% |
| Ex 61 | B | A | C | C | 6.1 | >1.0 | B | 0.29% | A | 13.7% | B | 0.11% |
| Ex 62 | B | A | C | C | 6.6 | >1.0 | B | 0.33% | A | 14.8% | B | 0.09% |
| Ex 63 | B | A | C | C | 5.9 | >1.0 | B | 0.37% | A | 12.0% | B | 0.14% |
| Ex 64 | B | A | C | C | 7.1 | >1.0 | B | 0.31% | A | 11.8% | B | 0.16% |
| Ex 65 | B | A | C | C | 6.8 | >1.0 | B | 0.36% | A | 13.6% | B | 0.12% |
| Ex 66 | B | A | C | C | 6.1 | >1.0 | B | 0.33% | A | 13.2% | B | 0.17% |

TABLE 3-4

| Remarks | Deviation angle of 0° to 50° from <001> orientation | Deviation angle of 20° to 50° from <001> orientation | Deviation angle of 0° to 20° from <101> orientation | Deviation angle of 0° to 10° from <101> orientation | Existence frequency of <101> orientation | Existence frequency of <001> orientation | Superelastic property [residual strain after 6% ]deformation | Superelastic property [residual strain after 6% deformation] | El | El | Quench-hardening sensitivity [α phase occupied ratio] | Quench-hardening sensitivity [α phase occupied ratio] |
|---|---|---|---|---|---|---|---|---|---|---|---|---|
| C Ex 1 | | | | | Wire breakage, impossible to work | | | | | | | |
| C Ex 2 | D | D | D | D | 2.5 | >1.0 | D | 1.82% | D | 4.9% | B | 0.11% |
| C Ex 3 | B | A | B | A | 6 | >1.0 | D | 3.80% | A | 12.7% | D | 16.4% |
| C Ex 4 | B | A | B | A | 5.5 | >1.0 | D | 3.20% | A | 12.2% | D | 13.9% |
| C Ex 5 | D | D | D | D | 4.5 | >1.0 | D | 1.23% | D | 5.3% | B | 0.07% |
| C Ex 6 | D | D | D | D | 4 | >1.0 | D | 1.68% | D | 5.0% | B | 0.13% |
| C Ex 7 | D | D | D | D | 3.8 | >1.0 | D | 1.55% | D | 5.1% | B | 0.11% |
| C Ex 8 | D | D | D | D | 1.5 | >1.0 | D | 2.44% | D | 4.5% | B | 0.15% |
| C Ex 9 | D | D | D | D | 1.7 | 2.4 | D | 1.74% | D | 5.0% | B | 0.07% |
| C Ex 10 | D | D | D | D | 2.2 | >1.0 | D | 1.82% | D | 4.9% | B | 0.16% |
| C Ex 11 | D | D | D | D | 2.5 | >1.0 | D | 1.53% | D | 5.1% | B | 0.14% |
| C Ex 12 | D | D | D | D | 3.7 | >1.0 | D | 1.31% | D | 5.2% | B | 0.11% |
| C Ex 13 | D | D | D | D | 3.3 | >1.0 | D | 1.20% | D | 5.3% | B | 0.16% |
| C Ex 14 | D | D | D | D | 2.7 | >1.0 | D | 1.73% | D | 5.0% | B | 0.13% |
| C Ex 15 | D | D | D | D | 2.5 | >1.0 | D | 1.80% | D | 4.9% | B | 0.07% |
| C Ex 16 | D | D | D | D | 3 | >1.0 | D | 2.10% | D | 4.7% | B | 0.06% |
| C Ex 17 | D | D | D | D | 2.1 | 2.2 | D | 2.50% | D | 4.5% | B | 0.15% |
| C Ex 18 | D | D | D | D | 2.2 | >1.0 | D | 1.65% | D | 5.0% | B | 0.13% |
| C Ex 19 | D | D | D | D | 2.5 | >1.0 | D | 1.70% | D | 5.0% | B | 0.14% |
| C Ex 20 | D | D | D | D | 2.3 | >1.0 | D | 1.94% | D | 4.8% | B | 0.13% |
| C Ex 21 | D | D | D | D | 2 | 2 | D | 2.80% | D | 4.3% | B | 0.18% |
| C Ex 22 | D | D | D | D | 2.4 | >1.0 | D | 1.73% | D | 5.0% | B | 0.09% |
| C Ex 23 | D | D | D | D | 2.3 | >1.0 | D | 1.48% | D | 5.1% | B | 0.12% |

As is obvious from the results shown above, Examples 1 to 66 are excellent in superelastic characteristics and elongation as they satisfy the texture orientation defined in the present invention.

In the Examples, for (1) a deviation angle of 0° to 50° from the <001> orientation, (2) a deviation angle of 20° to 50° from the <001> orientation, (3) a deviation angle of 0° to 20° from the <101> orientation, and (4) a deviation angle of 0° to 10° from the <101> orientation, as the degree of integration increases in the order of (1)→(2)→(3)→(4), the alloys exhibit superior effects and satisfactory superelastic characteristics. In order to obtain satisfactory textures, there are optimum values for the respective conditions, and the following results were recognized in the respective cases.

As the rate of temperature raise to the β phase temperature is milder in the heat treatment, the degree of integration for the deviation angle of 20° to 50° from the <001> orientation is increased, and the rate of 5° C./min is effective compared to the rate of 20° C./min, while the most excellent effect is exhibited at a rate of 0.2° C./min to 3.3° C./min.

The intermediate annealing temperature has an optimum value on the lower temperature side, and when the temperature is 450° C. to 500° C., the degree of integration is increased for the deviation angle of 0° to 20° from the <101> orientation. Thus, the most satisfactory results are exhibited.

In regard to the number of cycles of cold working, as the number of cycles is higher, the degree of integration is increased for the deviation angle of 0° to 10° from the <101> orientation. Particularly, such a tendency was confirmed for an intermediate annealing temperature of 450° C. to 500° C.

In regard to the alloy composition, Examples 51 to 53 according to the present invention are superior in superelastic characteristics compared to Examples 54 to 56. Particularly excellent results were obtained from an Al content of 7 to 9% by mass, and particularly excellent results were obtained from a Mn content of 8 to 13% by mass.

On the other hand, Comparative Example 1 was broken in the middle course because the intermediate annealing temperature was too low, and cold-wire-drawing could not be achieved at a necessary working ratio. Comparative Example 2 did not satisfy the orientation of texture because the intermediate annealing temperature was too low, and thus, the alloy was poor in superelastic characteristics and elongation. Since Comparative Examples 3 and 4 contained Ni at contents too high for the alloying components, although the alloys satisfied the texture orientation as defined in the present invention, the alloys were poor in quench-hardening sensitivity. Thus, precipitation of an α phase was confirmed, and the superelastic characteristics were also poor. Comparative Examples 5 to 7 and 12 to 20 involved excessively high rates of temperature raise in the heat treatment, Comparative Examples 8 to 11 involved excessively low cold working ratios between annealings, and Comparative Examples 21 to 23 involved excessively high intermediate annealing temperatures. Thus, the respective alloys could not satisfy the texture orientation as defined in the present invention, and were poor in superelastic characteristics and elongation.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A Cu—Al—Mn-based alloy having a composition consisting of 3 to 10% by mass of Al; 5 to 20% by mass of Mn; 0.001 to 10% by mass in total of at least one element selected from the group consisting of Co, Fe, Ti, V, Cr, Si, Nb, Mo, W, Sn, Mg, P, Be, Sb, Cd, As, Zr, Zn, B, C, Ag and misch metal; and 0 to 1% by mass of Ni, with the balance being Cu and unavoidable impurities, having superelastic characteristics, and having a recrystallized texture substantially formed of a β single phase, wherein 70% or more of crystal grains is within a range of 20° to 50° in a deviation angle from <001> orientation of a crystalline orientation measured in a working direction by electron back-scatter diffraction patterning, wherein 50% or more of the crystal grains is within a range of 0° to 20° in a deviation angle from <101> orientation of the crystalline orientation measured in the working direction, and wherein the Cu—Al—Mn-based alloy does not have any bamboo texture.

2. A wire formable from the Cu—Al—Mn-based alloy according to claim 1.

3. A sheet formable from the Cu—Al—Mn-based alloy according to claim 1.

4. A Cu—Al—Mn-based alloy producible by the method of producing a Cu—Mn—Al-based alloy having a composition consisting of 3 to 10% by mass of Al; 5 to 20% by mass of Mn; 0.001 to 10% by mass in total of at least one element selected from the group consisting of Co, Fe, Ti, V, Cr, Si, Nb, Mo, W, Sn, Mg, P, Be, Sb, Cd, As, Zr, Zn, B, C, Ag and misch metal; and 1% by mass or less of Ni, with the balance being Cu and unavoidable impurities, through [Step 1] to [Step 5]:

melting and casting [Step 1] an alloy material which gives the composition;

subjecting to hot working [Step 2];

carrying out at least one each in this order: intermediate annealing at 400° C. to 600° C. for 1 minute to 120 minutes [Step 3] and cold working at a working ratio of 30% or higher [Step 4]; and then carrying out heat treatment [Step 5], wherein the heat treatment [Step 5] contains steps of a heat treatment of:

heating the alloy from room temperature to a temperature range for obtaining a β single phase at a rate of temperature raise of 0.2° C./min to 20° C./min, and maintaining the alloy at the heating temperature; and then quenching, wherein 70% or more of crystal grains is within a range of 20° to 50° in a deviation angle from <001> orientation of a crystalline orientation measured in a working direction by electron back-scatter diffraction patterning, wherein 50% or more of the crystal grains is within a range of 0° to 20° in a deviation angle from <101> orientation of the crystalline orientation measured in the working direction, wherein the Cu—Al—Mn-based alloy does not have any bamboo texture, and wherein the heat treatment [Step 5] is carried out one time only.

* * * * *